US009115888B2

(12) United States Patent
Wada et al.

(10) Patent No.: US 9,115,888 B2
(45) Date of Patent: Aug. 25, 2015

(54) RICH-LEAN COMBUSTION BURNER

(75) Inventors: Norihide Wada, Hyogo (JP); Takashi Akiyama, Hyogo (JP); Takeshi Wakada, Hyogo (JP); Itsuo Nagai, Hyogo (JP); Ryosuke Umakoshi, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 498 days.

(21) Appl. No.: 13/483,900

(22) Filed: May 30, 2012

(65) Prior Publication Data

US 2012/0308945 A1 Dec. 6, 2012

(30) Foreign Application Priority Data

May 30, 2011 (JP) ..... 2011-121113

(51) Int. Cl.

| | |
|---|---|
| ***F23C 6/02*** | (2006.01) |
| ***F23D 14/04*** | (2006.01) |
| ***F23D 14/10*** | (2006.01) |
| ***F23D 14/46*** | (2006.01) |
| ***F23D 14/58*** | (2006.01) |

(52) U.S. Cl.

CPC ..... *F23C 6/02* (2013.01); *F23D 14/045* (2013.01); *F23D 14/105* (2013.01); *F23D 14/46* (2013.01); *F23D 14/586* (2013.01); *F23C 2201/20* (2013.01)

(58) Field of Classification Search

CPC ..... F23D 14/02; F23D 14/58; F23D 14/70; F23D 14/62; F23D 14/04; F23D 14/586; F23D 14/045; F23D 14/105; F23D 14/46; F23D 14/2201

USPC ..... 431/278, 354, 285, 328; 126/92 R, 126/92 AC, 92 C, 85 R, 91 R

See application file for complete search history.

(56) References Cited

U.S. PATENT DOCUMENTS 5,525,054 A * 6/1996 Nakaura et al. ..... 431/285

FOREIGN PATENT DOCUMENTS

| | | | |
|---|---|---|---|
| JP | 07-042917 | A | 2/1995 |
| JP | 07-310906 | | 11/1995 |
| JP | 11-051328 | A | 2/1999 |
| JP | 2002-048312 | A | 2/2002 |
| JP | 2002-048314 | A | 2/2002 |

(Continued)

OTHER PUBLICATIONS

Japanese Office Action issued Aug. 26, 2014 for corresponding Japanese Application No. 2011-121113.

*Primary Examiner* — Alfred Basichas

(74) *Attorney, Agent, or Firm* — Fishman Stewart Yamaguchi PLLC

(57) ABSTRACT

A rich-lean combustion burner has a supply channel through which a lean-side mixture is supplied to lean-side flame holes; and a supply channel through which a rich-side mixture is supplied to rich-side flame holes. The supply channels are partitioned from each other. A third plate member including a pair of plate parts which are bent to form a V shape at its lower end edge as a fold line is employed to form a central rich-side burner part. A slit part is partitioned and formed between side edges of a pair of first plate members on both longitudinal sides for forming lean-side flame holes on widthwise sides of the central rich-side burner part. With the lower end part in front, the V-shaped third plate member s inserted into the slit part, thereby being interposed between the first plate members.

8 Claims, 16 Drawing Sheets

(56) References Cited

FOREIGN PATENT DOCUMENTS

| | | | |
|---|---|---|---|
| JP | 2002-115817 | A | 4/2002 |
| JP | 2003-269705 | A | 9/2003 |
| JP | 2003-269707 | A | 9/2003 |
| JP | 2007-285536 | A | 11/2007 |
| JP | 2008-286448 | A | 11/2008 |

* cited by examiner

RICH-LEAN COMBUSTION BURNER

TECHNICAL FIELD

The present invention relates to a rich-lean combustion burner provided with rich-side and lean-side flame holes. This invention relates in particular to technology capable of eliminating, by ensuring that rich-side mixture supply channels to rich-side flame holes and lean-side mixture supply channels to lean-side flame holes are partitioned from one another, the possibility of leakage or other trouble which is likely to occur when the rich-lean combustion burner having a flat shape as a whole is formed by joining or welding together thin plate members which are formed into their predetermined shapes by means of press forming or other like forming means.

BACKGROUND ART

Heretofore, there have been proposed various types of rich-lean combustion burners. In such a type of rich-lean combustion burner, a lean-side mixture the air ratio of which is in excess of 1.0 is burned at lean-side flame holes for the accomplishment of NOx reduction, while for the stabilization of combustion flames, rich-side flame holes where a rich-side mixture the air ratio of which is below 1.0 is burned are arranged adjacent to the lean-side flame holes. And, as such a rich-lean combustion burner, there has been proposed a rich-lean combustion burner which is formed in the form of a flat shape as a whole by joining or welding together thin plate members formed into their predetermined shapes by means of press forming or other like forming means (see, for example, Patent Literature Publications 1 and 2).

Especially, Patent Literature Publication 1 proposes that work improvement in the cutting process to be performed on individual members as well as in the joining/welding process to be performed on the individual members is accomplished by performing bending of a single sheet of thin material for more than once. In addition, Patent Literature Publication 2 proposes that the sealability is ensured by means of concavity/convexity fitting of ribs instead of the aforesaid surface-to-surface joint.

CITATION LIST

Patent Literature

Patent Literature Publication 1: JP-A-2002-48312
Patent Literature Publication 2: JP-A-2003-269707

SUMMARY OF INVENTION

Technical Problem

However, each member made of thin plate material may vary in size in the course of manufacture. Especially when forming a rich-lean combustion burner in the form of a flattened shape, it is envisaged that close-contact portions that should be closely fit together in the thickness direction will be brought into mere contact with each other, thereby resulting in creation of a slight clearance gap therebetween. In addition, especially in the case where, in forming such a flattened rich-lean combustion burner, there is carried out an assembly process by which to place an inner member into inside of an outer member in the longitudinal direction, the longitudinal position of the inner member with respect to the outer member becomes unstable if the longitudinal dimension of the inner member varies towards the short side during the process of manufacture of the inner member. It is therefore envisaged that the outer member and the inner member will not be closely joined together, being out of originally-intended design. If by any possibility there occurs such a condition, it may become impossible to provide a certain degree of sealability as originally intended to accomplish or a certain degree of sealability as a target. If, due to such inconvenience, leakage takes place between the lean-side mixture supply channel and the rich-side mixture supply channel, this may cause the rich-side mixture to get mixed in with the lean-side mixture or will cause the lean-side mixture to get mixed in with the rich-side mixture. As a result, it becomes impossible to maintain the originally-intended combustion state.

For example, referring to FIG. 16, there is shown by way of example an assembly state of the rich-lean combustion burner which is now being under development by the applicant of the present invention. In this assembly, two third plate members 600, 600 are joined together to make up a central rich-side burner part. The central rich-side burner part is disposed centrally in the thickness direction. Then, first plate members 400, 400 are placed on the central rich-side burner part from both sides thereof in the thickness direction. Further, second plate members 500, 500 are placed respectively over the first plate members 400, 400 from outside thereof. And these plate members are fixed together (for example, by means of welding) at their joint edges on both sides in the longitudinal direction. In such a case, if the dimensional error of the third plate members 600, 600 in the longitudinal direction varies towards the short side, this will make the relative positional relationship in the longitudinal direction between the central rich-side burner part (made up of the pair of the third plate members 600, 600) and the lean-side burner part (made up of the pair of the first plate members 400, 400) unstable. Due to this, it is envisaged that portions to be brought into close contact in the thickness direction will become unstable.

Therefore, the technical problem is to ensure that, even when process variation or the like occurs when the rich-lean combustion burner having a flat shape as a whole is formed by combination of various types of plate members, the sealability between the supply channel through which lean-side mixture is fed to lean-side flame holes and the supply channel through which rich-side mixture is fed to rich-side flame holes is effected so that the supply channels are partitioned from each other without fail.

Solution to Problem

The present invention is intended for a rich-lean combustion burner comprising a central plate member upon which other plate members are to be laid in a covering manner from both sides of the central plate member in order that either a rich-side mixture supply channel or a lean-side mixture supply channel is partitioned and formed between opposing plate members. In addition, the present invention includes the following characteristic particulars. That is, the rich-lean combustion burner according to the present invention is provided with an outer plate member which is opened at its upper end and which has opposing surfaces between which a predetermined clearance gap is partitioned and formed and an inner plate member which is interposed between the opposing surfaces of the outer plate member. And, the outer plate member is provided, at its both longitudinal side edges, with a slit part which has an inner width corresponding to the thickness of a side edge of the inner plate member and which opens upward. The inner plate member is formed by bending of a single sheet of plate material at the center thereof so as to have a pair of plate parts facing each other to form a V shape. In addition, the inner plate member is pushed in from the upper end opening of the outer plate member, with the bent part served as a lower end part, whereby the side edge of the inner plate member is pinched in the slit part to be assembled in a state of close contact therewith.

According to such a rich-lean combustion burner, because of the elastic resilience force of metallic thin plate material, spring back force acts on the pair of the plate parts making up the inner plate member, thereby forcing them to reopen in the form of a V shape at the bent part of the lower end part. And, owing to the action of such elastic resilience force, the outer surface of each of the plate parts is placed in a state of being pressed against its opposing surface of the outer place. Therefore, each plate part and the outer plate member are reliably brought into close contact with each other, whereby they are maintained in a state of high sealability. This makes it possible that the supply channel defined between the pair of the plate parts together making up the inner plate member and the supply channel defined between the inner plate member and the outer plate member are maintained in a state of being partitioned and shut off from each other. Because of this, even when one of the aforesaid supply channels is supplied with rich-side mixture while the other supply channel is supplied with lean-side mixture, the mixing between the rich-side mixture and the lean-side mixture is prevented without fail.

The rich-lean combustion burner as described above may employ a structure in which, in order that two rows of lean-side flame holes are disposed so as to sandwich, therebetween and from both sides, one row of central rich-side flame holes disposed so as to centrally longitudinally extend and in order that two rows of outer rich-side flame holes are disposed so as to sandwich, therebetween and from outside, both the two rows of lean-side flame holes, (i) the inner plate member forms a central rich-side burner part provided with the central rich-side flame hole row, (ii) the outer plate member forms a lean-side burner part which forms the lean-side flame hole rows on both outer sides of the central rich-side burner part and (iii) the outer rich-side flame hole rows are formed by different plate members. And, in such a structure, the lower end part of the inner plate member is exposedly disposed vertically halfway in a lean-side mixture supply channel partitioned and formed between the opposing surfaces of the outer plate member, and the lean-side mixture supply channel is divided by the lower end part of the inner plate member to provide separate extensions to the two rows of lean-side flame holes. Owing to this, even when the lower end part of the central rich-side burner part is disposed exposedly to the lean-side mixture supply channel, the lean-side mixture supply channel and the inside of the central rich-side burner part which is provided with the supply of rich-side mixture are blocked off from each other without fail to thereby maintain a state of high sealability therebetween, because the lower end part of the central rich-side burner part is formed by only bending of a single sheet of plate material, that is, there exists neither any joint nor any joint surface.

In addition, the rich-lean combustion burner may be additionally provided with the following configuration. More specifically, there is formed a convex rib which projects from the outer surface of each of the pair of plate parts of the inner plate member towards its opposing surface of the outer plate member. In addition, the convex rib is formed so as to extend along the boundary of a lean-side mixture supply channel partitioned and formed between the outer surface of each of the plate parts and the opposing surface of the outer plate member. And, the inner plate member is pushed in from the upper end opening of the outer plate member, whereby the convex rib is abuttingly fit against the opposing surface of the outer plate member. By addition of such a configuration, the rich-side mixture in the inner plate member and the lean-side mixture in the outer plate member are blocked off from each other without fail to thereby maintain a state of high sealability therebetween.

Furthermore, one of the slit parts that is situated on the other longitudinal side of the outer plate member is provided with a minute projection which projects from an end surface of the slit part. For the case of such a projection, it may be additionally arranged that, when the inner plate member is pushed in from the upper end opening of the outer plate member, the inner plate member abuts against the projection, whereby the inner plate member is shifted a minute distance to one longitudinal end from the other longitudinal end. By addition of such an arrangement, even if the longitudinal dimension of the inner plate member is formed towards the short side due to process variation, the side edge of the inner plate member abuts against the projection as it is pushed in into the slit part from the upper end opening of the outer plate member, whereby the inner plate member is shifted for a distance corresponding to the process variation towards the one longitudinal side. Owing to this, it becomes possible that, with respect to the outer plate member, the inner plate member is positioned at a predetermined design location. Therefore, even when process variations occur, it is still possible to secure design sealability.

In addition, it may be arranged that the end surface of one of the slit parts that is situated on the other longitudinal side of the outer plate member is formed so as to slopingly extend at a slight downward inclination from above to below. And, it is possible to add a configuration that, when the inner plate member is pushed in from the upper end opening of the outer plate member, the inner plate member is guided by the end surface of the sloping slit part and shifted a minute distance to one longitudinal side from the other longitudinal side. This makes it possible to accomplish the same effects that the projection does. In other words, as the side edge of the inner plate member is pushed into the slit part from the upper end opening of the outer plate member, it is guided by the sloping slit part, whereby the inner plate member is shifted for a distance corresponding to the process variation towards the one longitudinal side. Owing to this, it becomes possible that, with respect to the outer plate member, the inner plate member is positioned at a predetermined design location. Therefore, even when process variations occur, it is still possible to secure design sealability.

Finally, it becomes possible to provide a combustion apparatus comprising a rich-lean combustion burner as described above and capable of providing the aforesaid various advantageous effects.

DESCRIPTION OF EMBODIMENTS

Hereinafter, embodiments of the present invention will be described with reference to the drawings.

Figure 1:
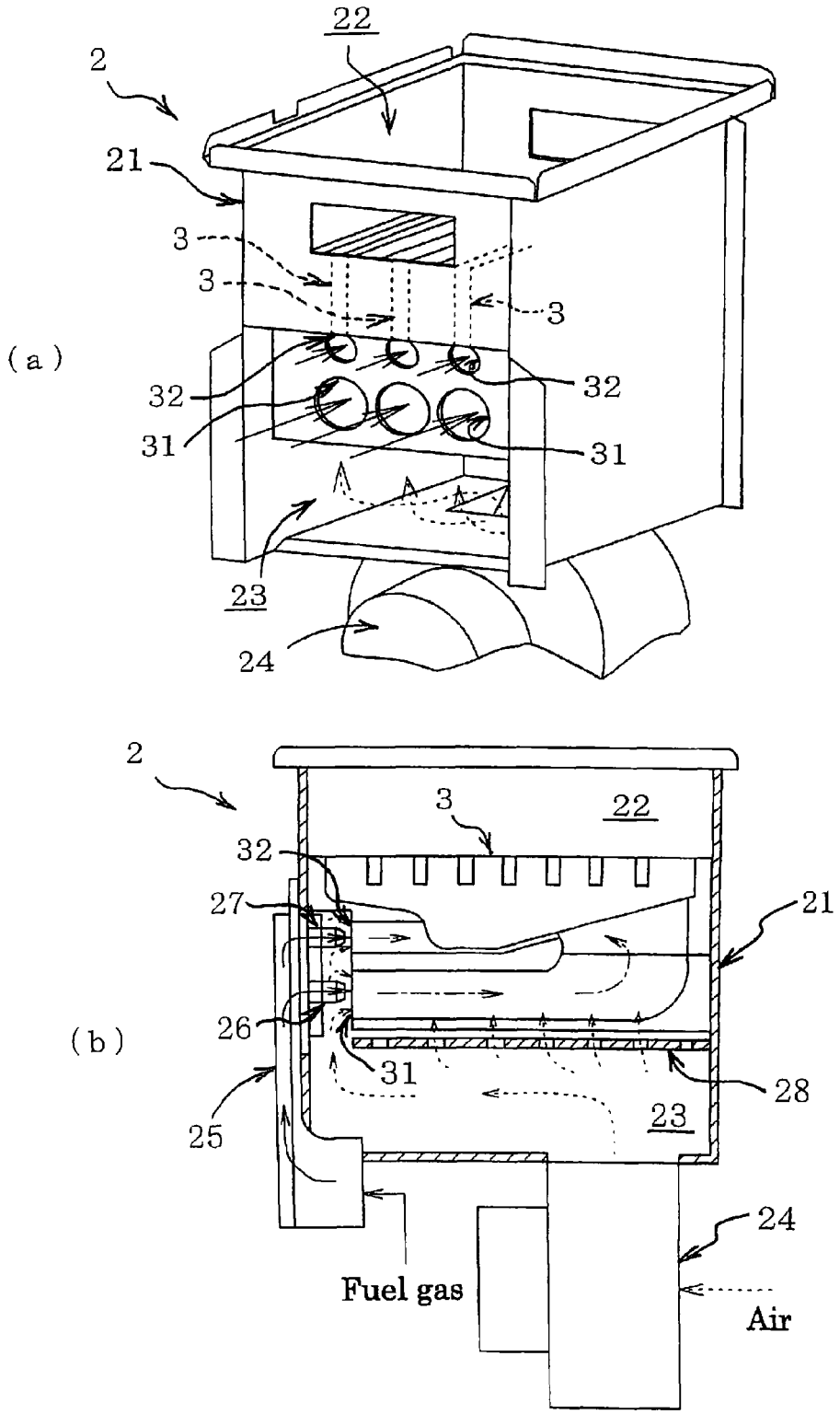
FIG. 1, comprised of FIGS. 1(*a*), (*b*), shows an example of a combustion apparatus into which a rich-lean combustion burner of the present invention is incorporated, wherein FIG. 1(*a*) is an illustration diagram showing a perspective view of the rich-lean combustion burner and FIG. 1(*b*) is an illustration diagram showing a cross-sectional view of the rich-lean combustion burner.

Referring to FIG. 1, there is shown a combustion apparatus 2 into which a rich-lean combustion burner according to a first embodiment of the present invention is incorporated. The combustion apparatus 2 includes a can body 21. A set of burners, made up of a predetermined number of rich-lean combustion burners 3, 3, . . . which are laterally adjacently arranged side by side, is firmly fixed in the can body 21. The can body 21 has an upper space which serves as a combustion space 22 and a lower space 23 which is supplied with combustion air from an air distribution fan 24. There is disposed on one side of each rich-lean combustion burner 3 a gas manifold 25 (shown only in FIG. 1(*b*)). Two gas nozzles 26, 27 are projected from the gas manifold 25 to a corresponding rich-lean combustion burner 3. One of the gas nozzles (the lower one), i.e., the gas nozzle 26, is configured so as to be able to jet fuel gas in the direction of a first supply port 31 of the rich-lean combustion burner 3. The other gas nozzles (the upper one), i.e., the gas nozzle 27, is configured so as to be able to jet fuel gas in the direction of a second supply port 32 of the rich-lean combustion burner 3. And, it is arranged that air from the lower space 23 is forced in from around each gas nozzle 26, 27 with the aid of discharge pressure of the air distribution fan 24 so that both fuel gas and air are supplied to the first and the second supply ports 31, 32. In this case, the diameter of the first supply port 31 is set to be considerably larger than the outer diameter of the nozzle 26, whereby larger amounts of air are forced in. On the other hand, the diameter of the second supply port 32 is set to be slightly larger than the outer diameter of the nozzle 27 to thereby reduce the amount of air to be forced in. Owing to such arrangement, the first supply port 31 supplies, in addition to fuel gas supplied therefrom, air to the inside at an amount that provides a predetermined air ratio of in excess of 1.0 in comparison to the amount of the fuel gas supplied. On the other hand, the second supply port 32 likewise supplies, in addition to fuel gas supplied therefrom, air to the inside at an amount that provides a predetermined air ratio of less than 1.0 in comparison to the amount of the fuel gas supplied. In addition, a current plate 28 (see FIG. 1(*b*)) is disposed serving as a partition between the lower space 23 and the rich-lean combustion burners 3, 3, . . . and a great number of small bores are opened through the current plate 28, whereby the supply of secondary air is provided, through these small bores, between adjoining rich-lean combustion burners 3, 3.

First Embodiment

Figure 2:
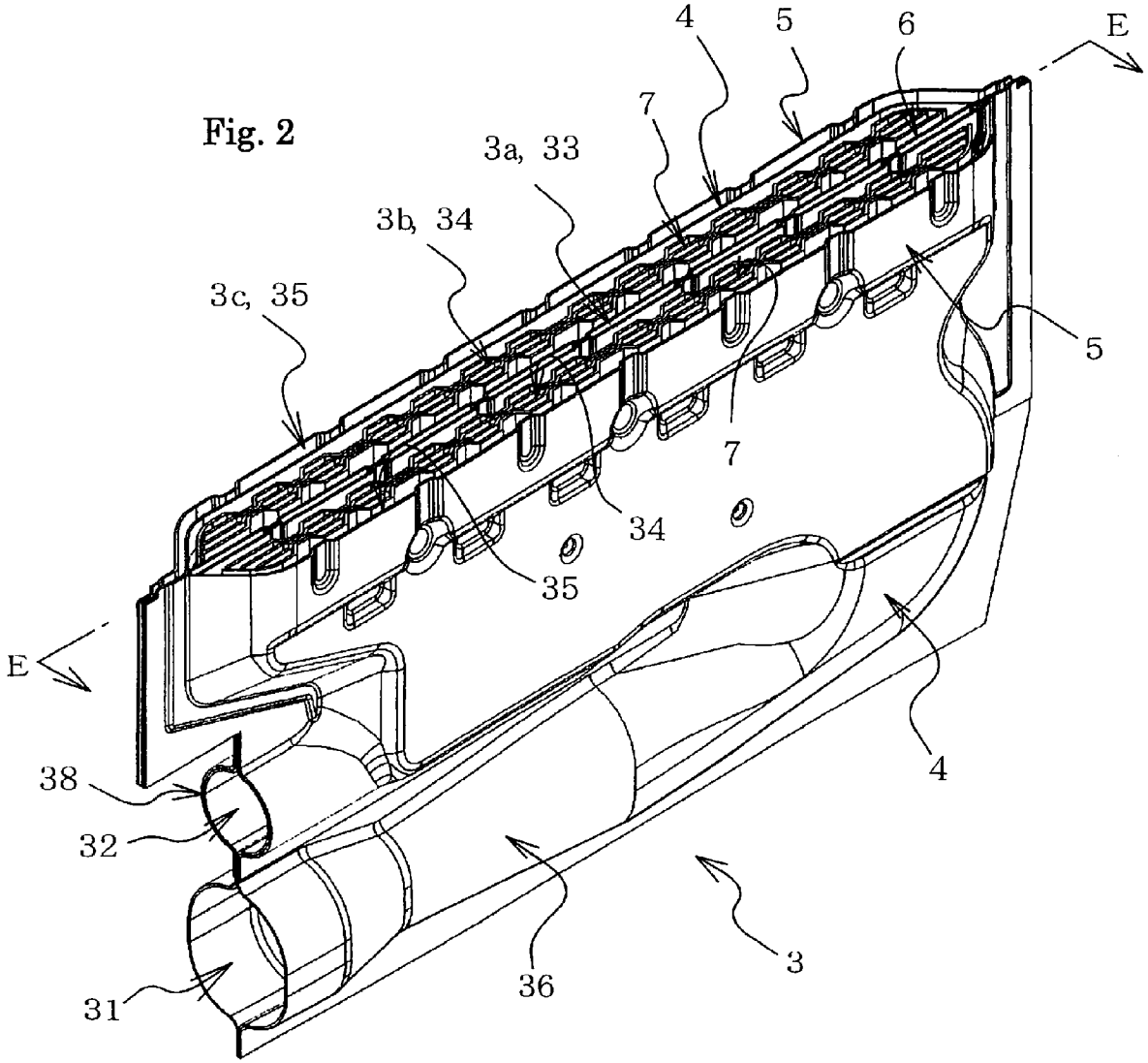
FIG. 2 is a perspective view of a rich-lean combustion burner according to a first embodiment of the present invention.
Figure 3:
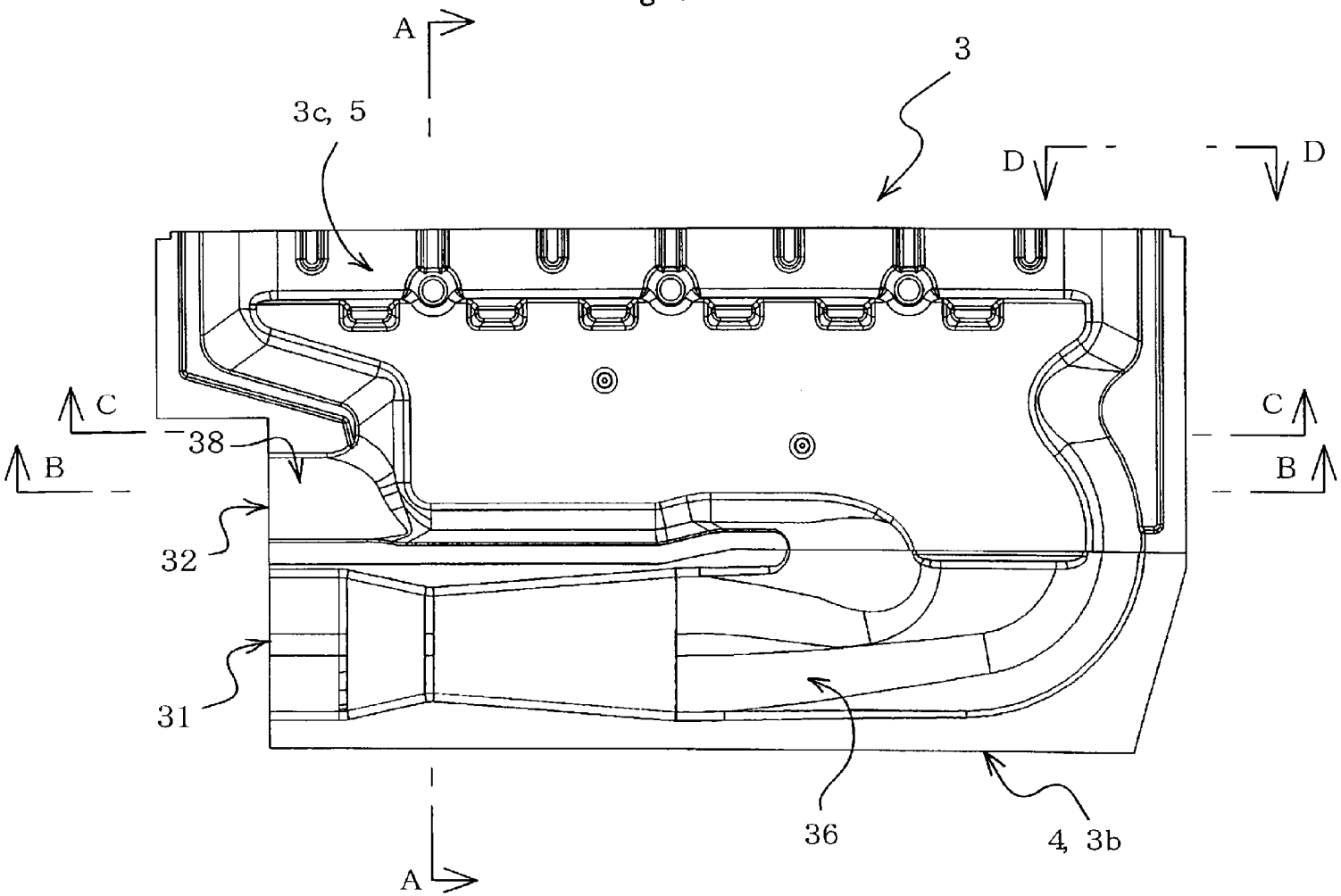
FIG. 3 is a front view of the burner of FIG. 2.
Figure 4:
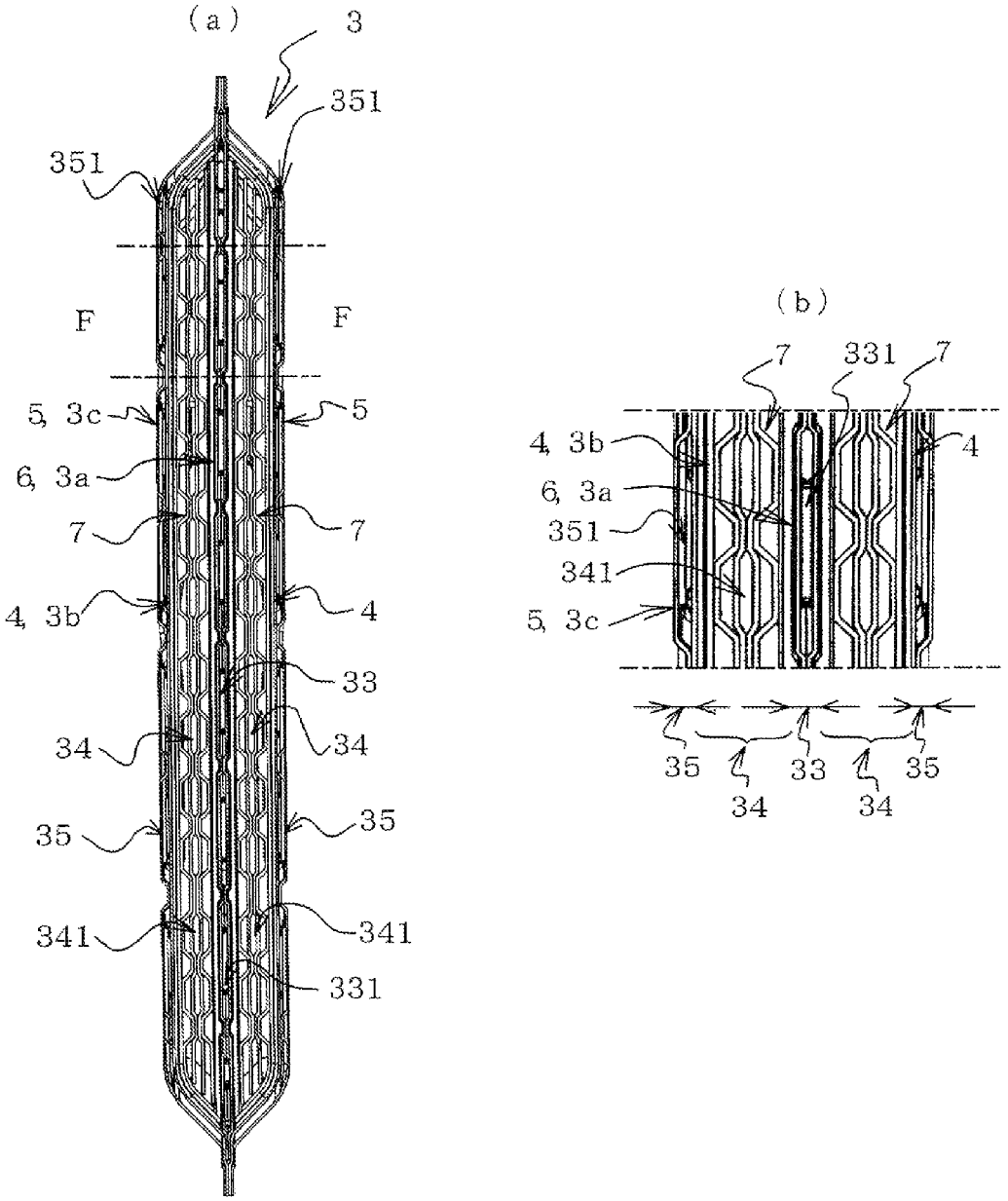
FIG. 4 is comprised of FIGS. 4(*a*), (*b*), wherein FIG. 4(*a*) is a top plan view of the burner of FIG. 2 and FIG. 4(*b*) is a partially enlarged view of an F-F part of FIG. 4(*a*)

As shown in FIG. 2, the rich-lean combustion burner 3 is formed by use of three different types of plate members made of metallic plate material which are formed into their respective predetermined shapes by press work and bending work (i.e., a pair of first plate members 4, 4, a pair of second plate members 5, 5 and a single third plate member 6) and a pair of lean-side flame hole forming members 7, 7. More specifically, the first plate members 4, 4 and the second plate members 5, 5 are overlapped in a manner as will be described later, with the third plate member 6 which is located centrally in the width direction (i.e., in the direction in which thickness is formed) sandwiched therebetween, whereby the rich-lean combustion burner 3 is provided. Such a rich-lean combustion burner 3 is so formed as to have a flattened shape as a whole. It is here assumed that the horizontal direction in FIG. 3 is the longitudinal direction (the length direction), the direction at right angles to the plane of paper of FIG. 3 is the lateral direction (the width direction) and the up and down direction of FIG. 3 is the vertical direction. The first supply port 31 and the second supply port 32 which has a smaller diameter than that of the first supply port 31 are opened respectively at a lower position and at an upper position on one longitudinal side (on the left-hand side in FIG. 3), and rows of flame holes where combustion flames are produced are formed in the upper end surface so as to extend in the longitudinal direction. As shown in FIG. 2 or FIGS. 4(*a*), (*b*), there are rows of flame holes including (i) a narrow-width rich-side flame hole row 33 situated in the lateral center and extending the entire longitudinal length, (ii) two relatively wide-width lean-side flame hole rows 34, 34 respectively situated on both lateral sides of the rich-side flame hole row 33 and extending the entire longitudinal length and (iii) two narrow-width rich-side flame hole rows 35, 35 respectively situated exterior to the lean-side flame hole rows 34, 34 and extending the entire longitudinal length. And, a lean-side mixture, internally mixed after being supplied from the first supply port 31, is directed to each of lean-side flame holes 341 of the lean-side flame hole rows 34, 34, whereby lean-side flames are produced using the lean-side mixture thus distributed. On the other hand, a rich-side mixture, internally mixed after being supplied from the second supply port 32, is directed to each of rich-side flame holes 331 of the rich-side flame hole row 33 situated at the center and to each of rich-side flame holes 351 of each of the two rich-side flame hole rows 35, 35 situated on both outer sides, whereby rich-side flames are produced using the rich-side mixture thus distributed.

Figure 5:
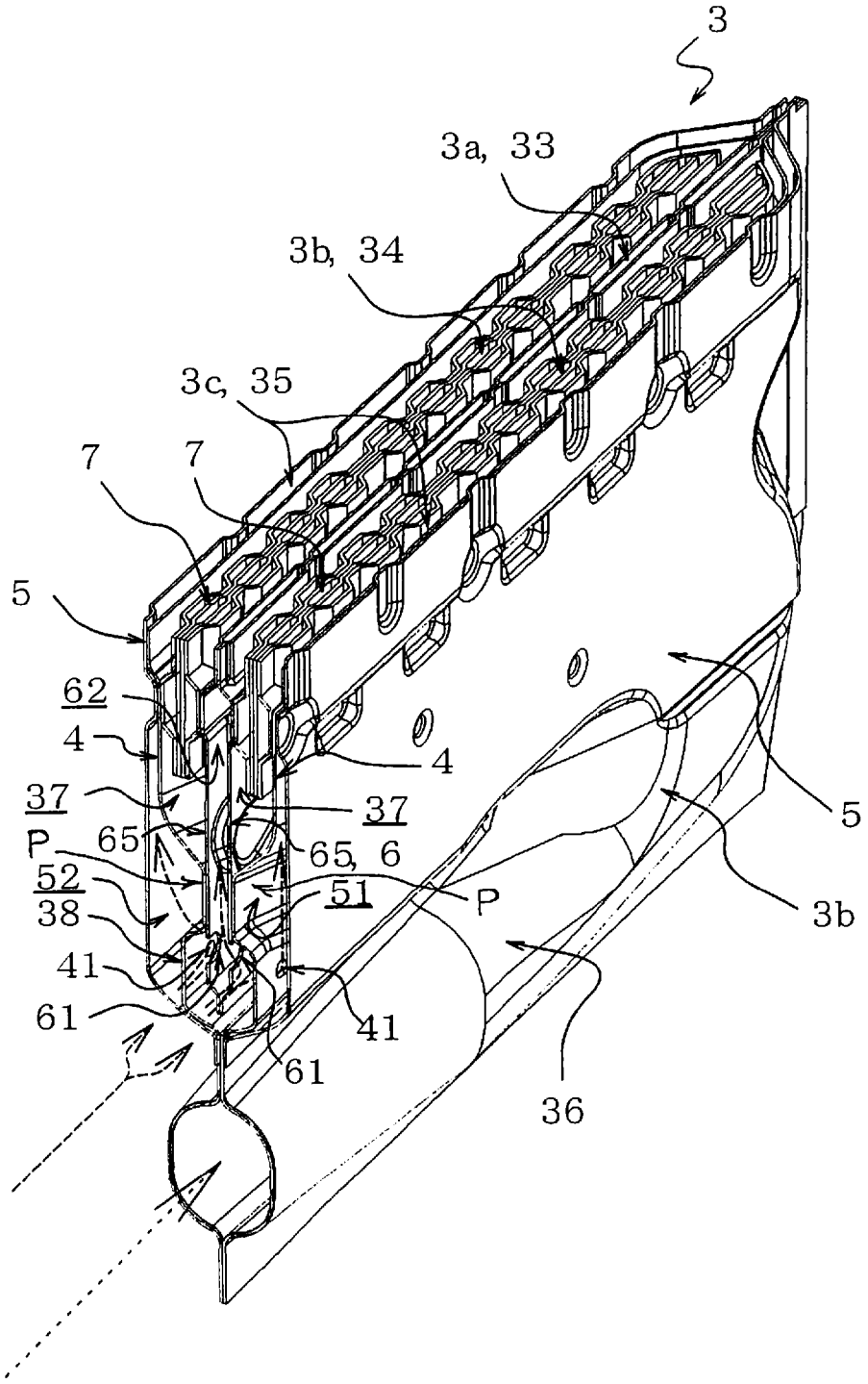
FIG. 5 is a partial perspective view when cut in section taken along line A-A of FIG. 3.

As shown in FIG. 5, the rich-side flame hole row 33 is formed by the third plate member 6. In other words, plate parts 65, 65 together making up the third plate member 6 are placed face to face with each other, with a predetermined clearance gap defined therebetween. There is formed between the inner surfaces of the plate parts 65, 65 a rich-side mixture supply channel in fluid communication with the rich-side flame hole row 33 at the upper end surface. In this way, the third plate member 6 makes up a central rich-side burner part 3*a*. A pair of first plate members 4, 4 are placed from both lateral sides so as to face each other, with the central rich-side burner part 3*a* sandwiched therebetween, and lean-side flame hole forming members 7, 7 are placed respectively in two upper end openings defined between each first plate member 4 and the central rich-side burner part 3*a*. This provides a lean-side burner part 3*b* which encloses the central rich-side burner part 3*a* from both lateral sides for the two lean-side flame hole rows 34 at the upper end surface to produce lean-side flames. And, a second plate member 5 is placed on the outside of each first plate member 4 of the lean-side burner part 3*b*, and the supply of rich-side mixture is distributed, through a supply channel defined between the inner surface of each second plate member 5 and its opposing surface, i.e., the outer surface of the first plate member 4, to the outer rich-side flame hole row 35. This makes up an outer rich-side burner part 3*c*.

Figure 6:
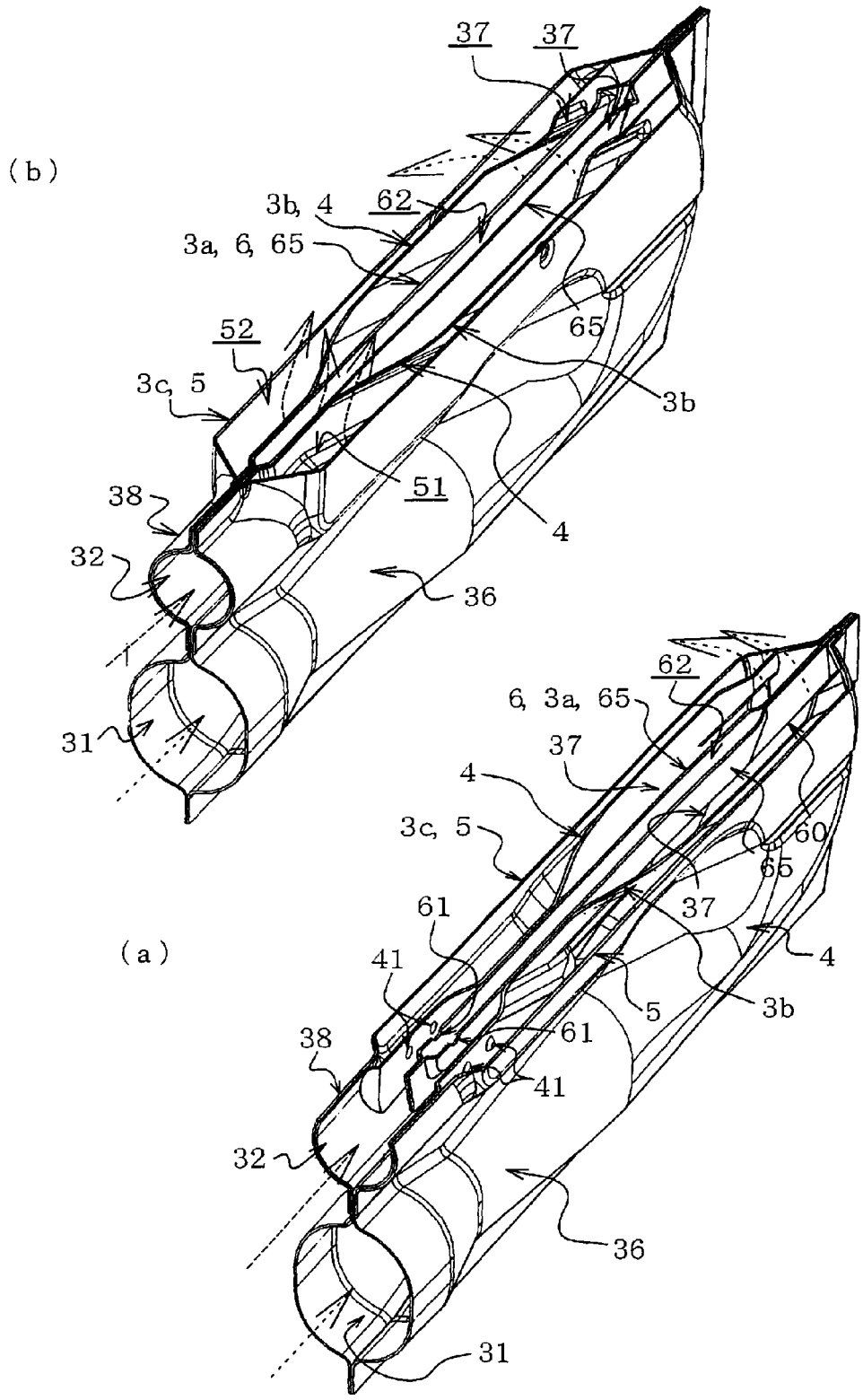
FIG. 6 is comprised of FIGS. 6(*a*), (*b*), wherein FIG. 6(*a*) is a perspective view when cut taken along line B-B of FIG. 3 and FIG. 6(*b*) is a perspective view when cut taken along line C-C of FIG. 3.

By the formation of the lean-side burner part 3*b*, the lean-side mixture (see dotted arrows of FIG. 6(*a*)) is distributed from the first supply port 31 on one longitudinal side to the other longitudinal side through a tubular part 36. Then, the flow of lean-side mixture changes direction at the other side so as to now flow upward. Thereafter, the lean-side mixture is supplied, through two internal spaces 37, 37 (see FIG. 5 and FIGS. 6(*a*),(*b*)) which are formed by partition (division) of a space between the pair of the first plate members 4, 4 by the third plate member 6, to the lean-side flame hole rows 34, 34 at the upper end surface. The tubular part 36 and the internal spaces 37, 37 together form a lean-side mixture supply channel for the supply of lean-side mixture to the two lean-side flame hole rows 34, 34 and in addition, the tubular part 36 serves as a mixing chamber and as a lean-side mixture introduction channel for fuel gas/air supplied from the first supply port 31. In addition, the third plate member 6 makes up a formation member used for partition formation of a first supply channel to be hereinafter described.

Figure 7:
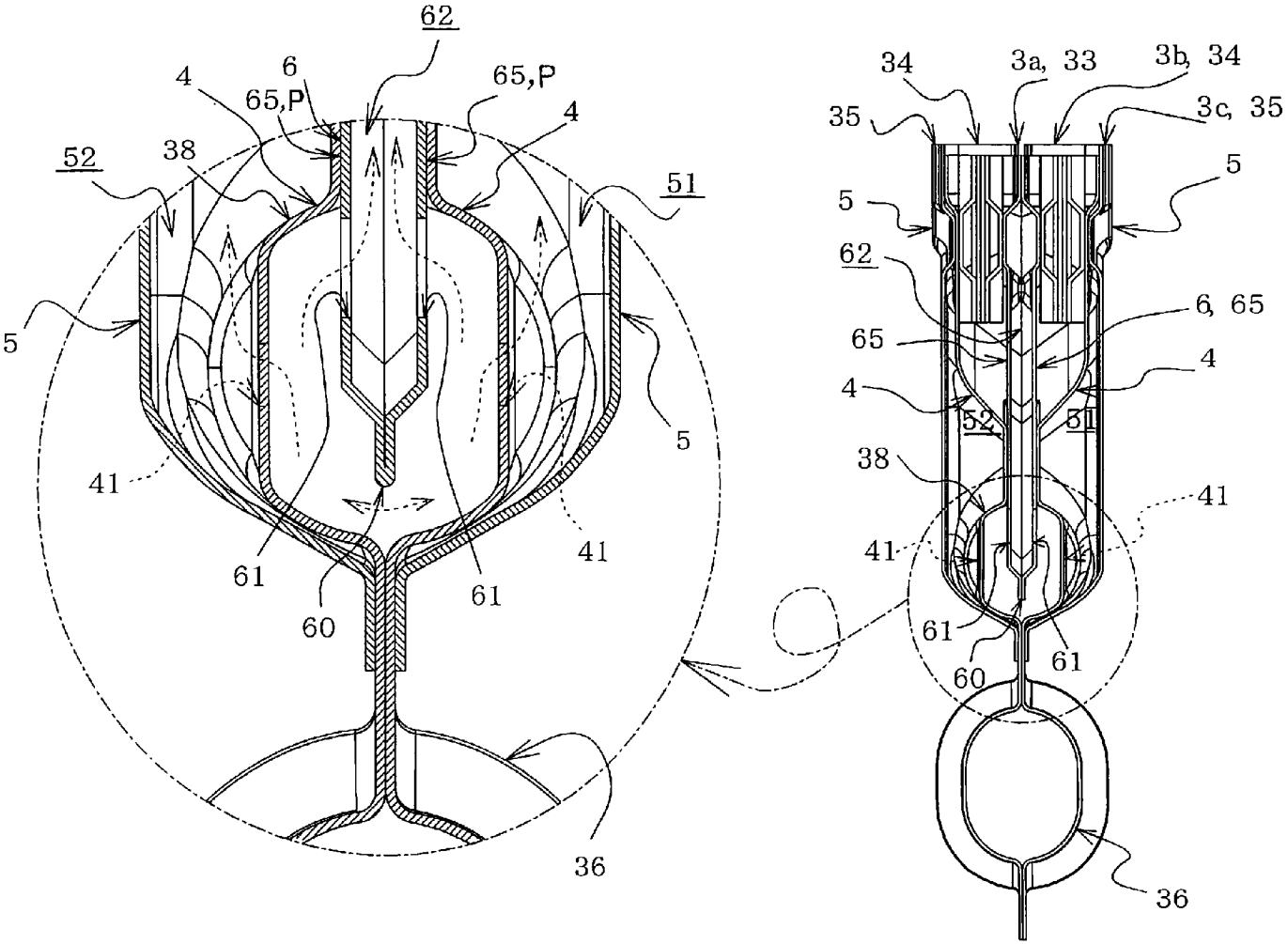
FIG. 7 is a partially enlarged cross-sectional illustration view taken along line A-A of FIG. 3.

The rich-side mixture from the second supply port 32 is directed through a tubular part 38 (see FIG. 6(*a*)) to the closed end thereof at the rear. Then, the rich-side mixture is supplied from the closed end of the tubular part 38 to the central rich-side burner part 3*a* and to the outer rich-side burner parts 3*c* on both sides in the horizontal direction. In other words, the lower end part 60 (see FIG. 7) of the third plate member 6 forming the central rich-side burner part 3*a* is inserted from above. That is, on the side of the closed end of the tubular part 38, the lower end part 60 is formed as a projecting portion which projects so as to be left in a suspended state in the tubular part 38. A communication hole 61 is formed in each of plate parts 65, 65 formed by bending at the lower end part 60. These communication holes 61, 61 bring the inside of the tubular part 38 into fluid communication with an internal space 62 of the central rich-side burner part 3*a*, whereby the rich-side mixture in the tubular part 38 is supplied through each communication hole 61 and through the internal space 62 to the rich-side flame hole row 33. On the other hand, communication holes 41, 41, . . . are formed also in the pair of the first plate members 4, 4 making up the tubular part 38. Through each communication hole 41 of the first plate member 4 on one side (the right-hand side of FIG. 7), the inside of the tubular part 38 is brought into fluid communication with an internal space 51 defined with the second plate member 5 on the same side of the first plate member 4 on the one side, while through each communication hole 41 of the first plate member 4 on the other side (the left-hand side of FIG. 7), the inside of the tubular part 38 is brought into fluid communication with an internal space 53 defined with the second plate member 5 on the same side of the first plate member 4 on the other side. Owing to such arrangement, the rich-side mixture in the tubular part 38 is supplied, through each communication hole 41 and the inner space 51 on the one side, to the rich-side flame hole row 35 (see FIG. 5) on the one side. On the other hand, the rich-side mixture in the tubular part 38 is supplied, through each communication hole 41 and the inner space 52 on the other side, also to the rich-side flame hole row 35 on the other side. In addition, the internal spaces 51, 52, 62 constitute, together with the tubular part 38, a rich-side mixture supply channel, other than which it is arranged that the tubular part 38 serves as a mixing chamber and as a rich-side mixture introduction channel for fuel gas and air supplied from the second supply port 32. To sum up, the internal space 51 constitutes a second supply channel. The internal space 52 constitutes a third supply channel. The internal space 62 constitutes a first supply channel.

In addition, the number of communication holes 61 (41) to be formed and the opening area thereof may be set so that the rich-side flame hole rows 35, 33 each are supplied with rich-side mixture at the same flow rate and pressure as the other. To this end, for example, it may be arranged such that the rich-side flame hole row 35 on one side, the rich-side flame hole row 35 on the other side and the rich-side flame hole row 33 are formed so as to have the same opening area while on the other hand the second communication holes 41, 41 on one side, the third communication holes 41, 41 on the other side and the first communication holes 61, 61 all in fluid communication with the tubular part 38 are formed so as to be identical with each other in their total opening area.

Next, description will be given regarding the assembly structure of the rich-lean combustion burner as well as the structure relating to the securing of sealability. The assembly procedure will be described with reference to FIG. 8. In the first place, a third plate member 6 and a lean-side burner part 3*b* into which the third plate member 6 is incorporated are prepared. The third plate member 6 (see FIG. 9) is formed using a material in the form of a thin plate. More specifically, the thin plate material is subjected to press working to form a plate part 65 serving as one of opposing sides and a plate part 65 serving as the other opposing side. Then, the thin plate material after press working, i.e., a plate member 6*a* in the form of a single sheet, is bent to form a V-shape. In other words, the plate member 6*a* is formed such that the plate parts 65, 65 are arranged in line symmetry across a fold line T passing through the center of the plate member 6*a* and, in addition, that their concave portions are in a state of being orientated in the same direction (in the upward direction in FIG. 9). And, the plate parts 65, 65 on both sides each are bent along the fold line T as a center such that they are directed inward (in the direction of an arrow indicated by chain line) so as to face each other. In a released state after bending, the bent portion becomes the lower end part 60 and the plate parts 65, 65 on both sides extending upward from the lower end part 60 will not enter into a state of being fully joined together. That is, by flexible return force, their upper ends are slightly separated from each other, whereby the plate parts 65, 65 are placed in a state of being opened in a V-shape.

On the other hand, the lean-side burner part 3*b* (see FIG. 8) is formed as follows. A pair of first plate members 4, 4 are placed face to face with each other and their side edges 42, 42, 43, 43 and lower end edges 44, 44 are brought together by welding. Next, a third plate member 6 is fit centrally in the width direction from the upper end opening in the way as will be described later. This is followed by fitting a pair of lean-side flame hole forming members 7, 7 from above so that they are placed on both width-wise sides of the third plate member 6, thereby making up a lean-side burner part 3*b* in which the side edges 42, 42, 43, 43 and the lower end edges 44, 44 are hermetically closed, but only the first and the second supply ports 31, 32 are opened laterally. It is noted that the fitting of the lean-side flame hole forming members 7, 7 may be carried out not in this process but in a subsequent process. Additionally, the second plate member 5 may be brought together with the outside of the first plate member 4, 4 by welding either in this process or in a subsequent process. Furthermore, it is also possible that at this stage, temporary tightening as a substitute for welding is carried out for the time being. And, welding is carried out in a subsequent process. By "welding" is meant the performance of dotted spot welding, linear welding or the like.

Figure 10:
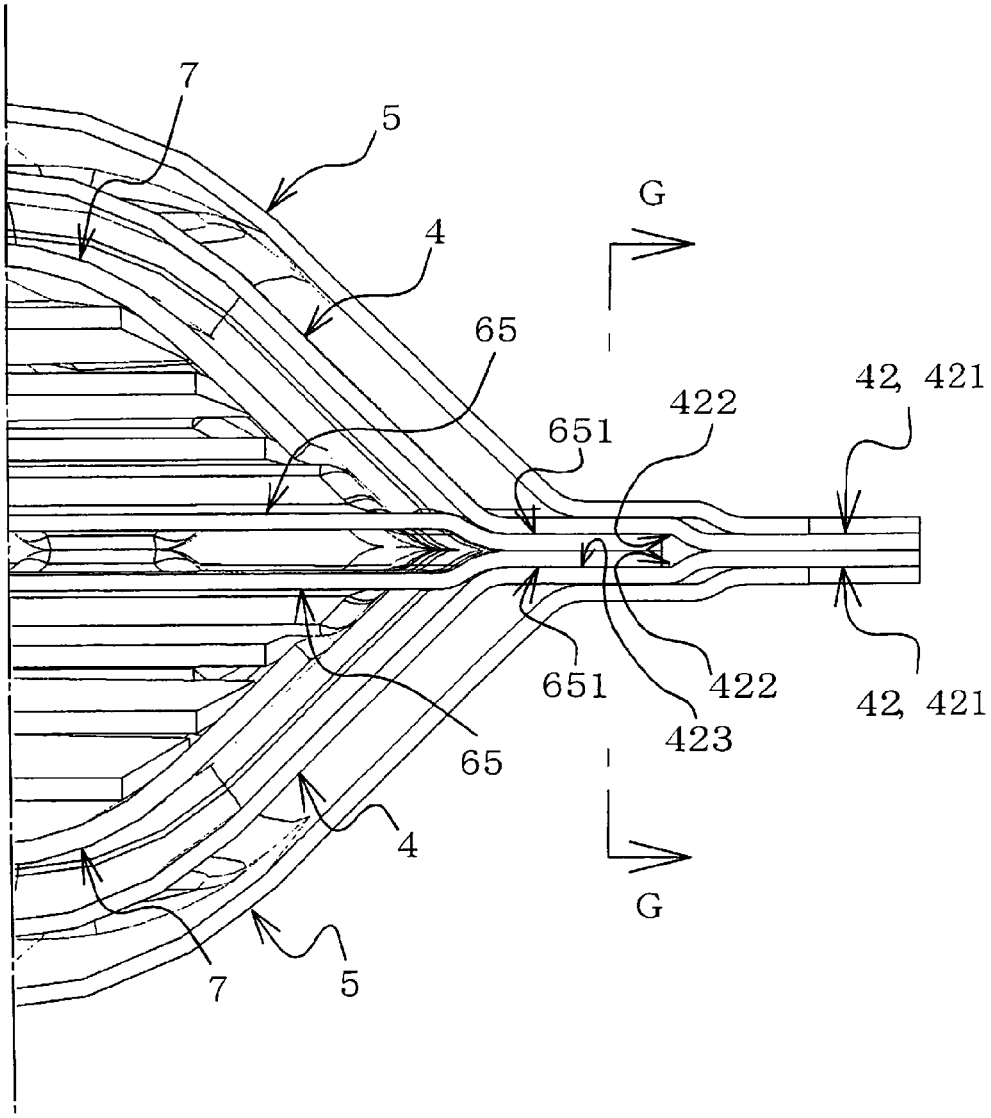
FIG. 10 is a partially enlarged illustration view of a part indicated by arrow D-D of FIG. 3.

Of the longitudinal side edges 42, 42, 43, 43 of the first plate members 4, 4 making up the lean-side burner part 3*b*, the longitudinal side edges 42, 42 include, as shown in FIG. 10, end edges 421, 421 which are brought into close contact with each other for welding and step parts 422, 422 located adjacent to the end edges 421, 421 and formed by means of stepped-inside press working. And, the side edges 42, 42 are brought together to thereby form a slit part 423 with a predetermined inner width between the opposing surfaces of the step parts 422, 422. The inner width of the slit part 423 is set such that longitudinal side edges 651, 651 of the plate parts 65, 65 of the third plate member 6 are pinched together from both width-wise sides, brought into close contact with each other and housed in the slit part 423. In other words, the inner width of the slit part 423 is set so as to correspond the sum of the plate thicknesses of the longitudinal side edges 651, 651 of the plate parts 65, 65.

Figure 8:
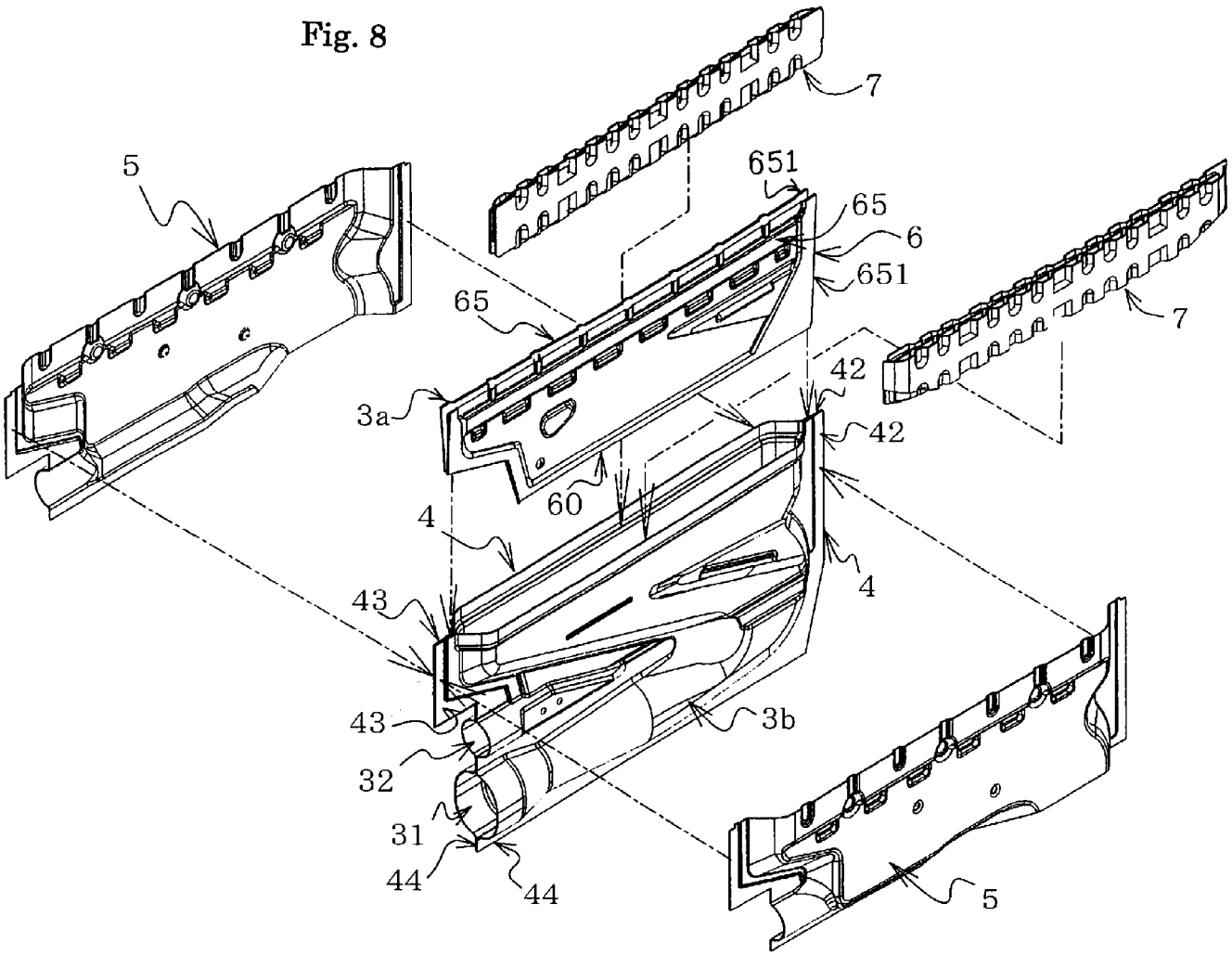
FIG. 8 is a perspective view showing, in an exploded manner, a single third plate member which composes a central rich-side burner part, a pair of flame hole members, which compose rows of lean-side flame holes and which are disposed on both sides of the central rich-side burner, a pair of first plate members and a pair of second plate members, for the purpose of providing an explanation of the assembly procedure of these components.
Figure 9:
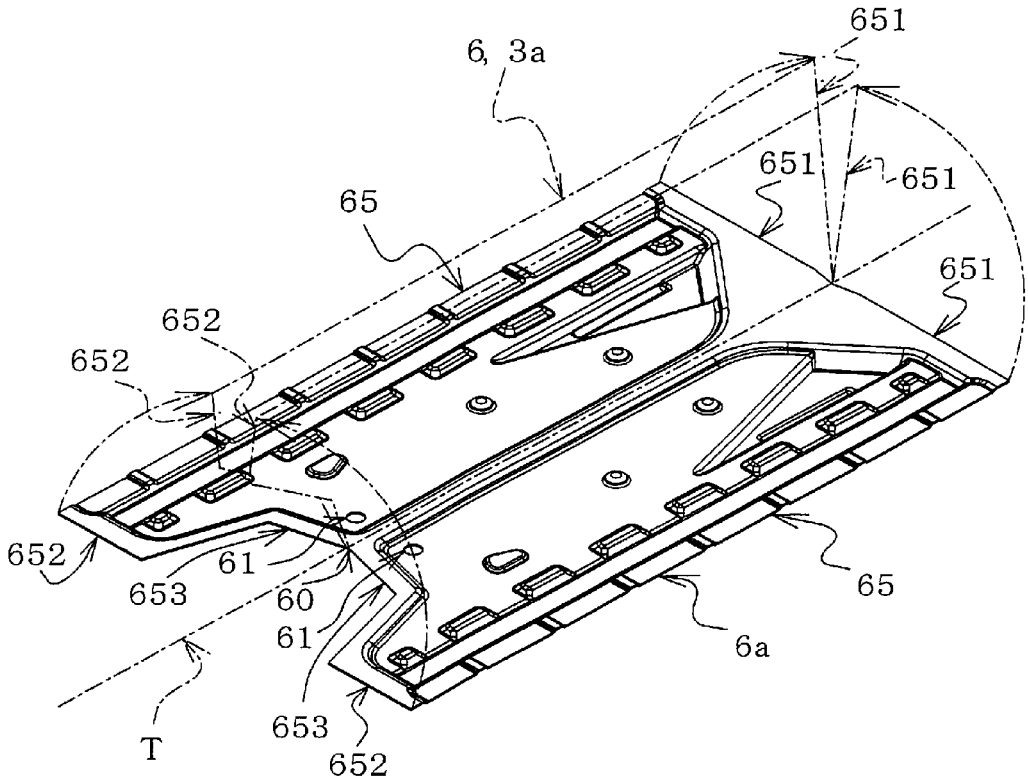
FIG. 9 is a perspective view illustrating a developed state of the third plate member which composes a central rich-side burner part and which is provided by bending a plate member in the form of a single sheet.
Figure 11:
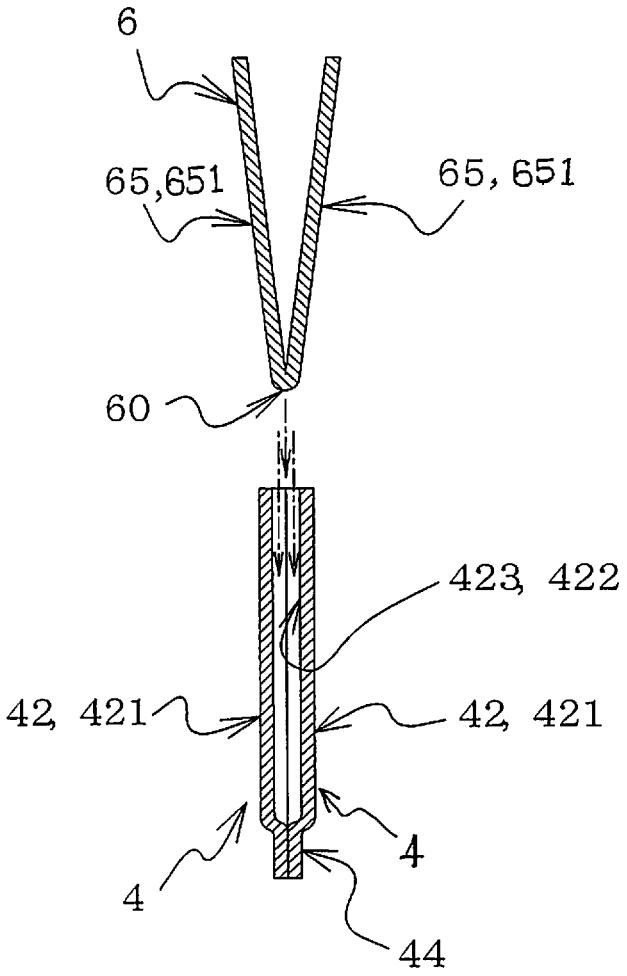
FIG. 11 is an illustration view explaining, with the aid of a cross section taken along line G-G of FIG. 10, the principle of assembly made by driving a third plate member into a slit part defined by a pair of first plate members.

Therefore, as shown in FIGS. 8 and 11, as the third plate member 6 bent in a V-shape is fit, with the lower end part 60 in front, into the upper end opening of the lean-side burner part 3*b*, the side edges 651, 651 of the third plate member 6 enter the slit part 423. And by further forcing the third plate member 6 into the slit part 423, the side edges 651, 651 are pinched together to change state from V-shape to such a state that they are forcibly brought into to contact with each other. And, the third plate member 6 is assembled, with the side edges 651, 651 brought together. As a result, there is now completed a rich-lean combustion burner.

For the case of a rich-lean combustion burner having an assembly structure as described above, elastic resilience force (spring back force) acts especially on the plate parts 65, 65 making up the central rich-side burner part 3*a*. This forces the plate parts 65, 65 to return to its original V-shape at the bending portion of the lower end part 60. Upon receipt of such an elastic resilience force, the outer surfaces of the plate parts 65, 65 (for example, see portions indicated by letter P in FIGS. 5 and 7) are pressed against their opposing width-wise inner surfaces of the first plate members 4, 4. Even when the longitudinal side edges are pinched together into close contact with each other, the elastic resilience force as described above acts in such a way that a portion defined between the side edges bulges outward to both lateral sides in the form of, for example, a drum. This ensures that the plate parts 65, 65 are brought into close contact with the first plate members 4, 4 to thereby maintain enhanced sealability. Owing to this, it becomes possible to maintain a state that the inside of the tubular part 38 through which the rich-side mixture flows (see, for example, FIG. 5) and the internal spaces 37, 37 through which the lean-side mixture flows are partitioned and blocked off from each other, thereby preventing the occurrence of the mixing between rich-side mixture and lean-side mixture without fail.

Figure 12:
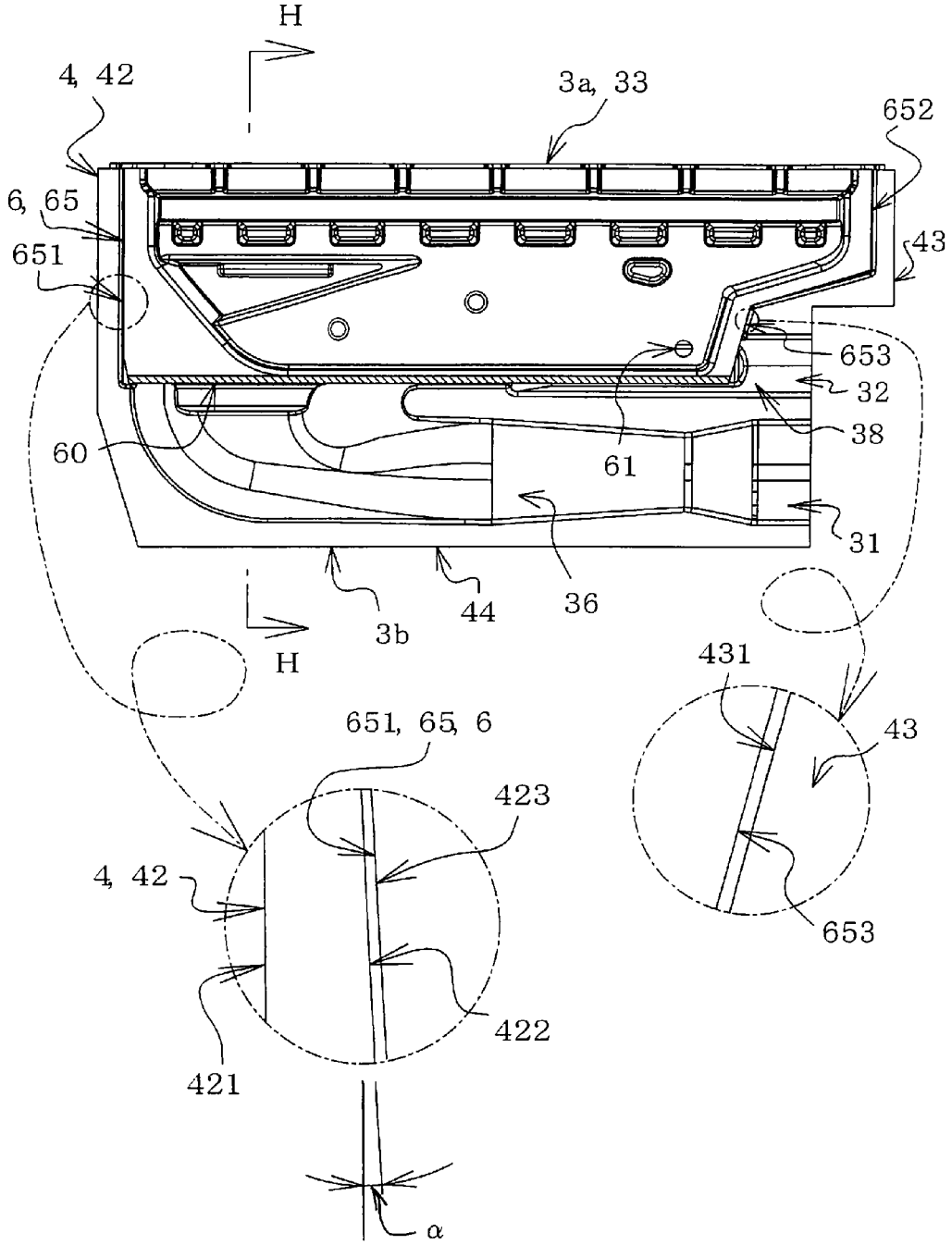
FIG. 12 is a front illustration view showing a state when separated by line E-E of FIG. 2.
Figure 13:
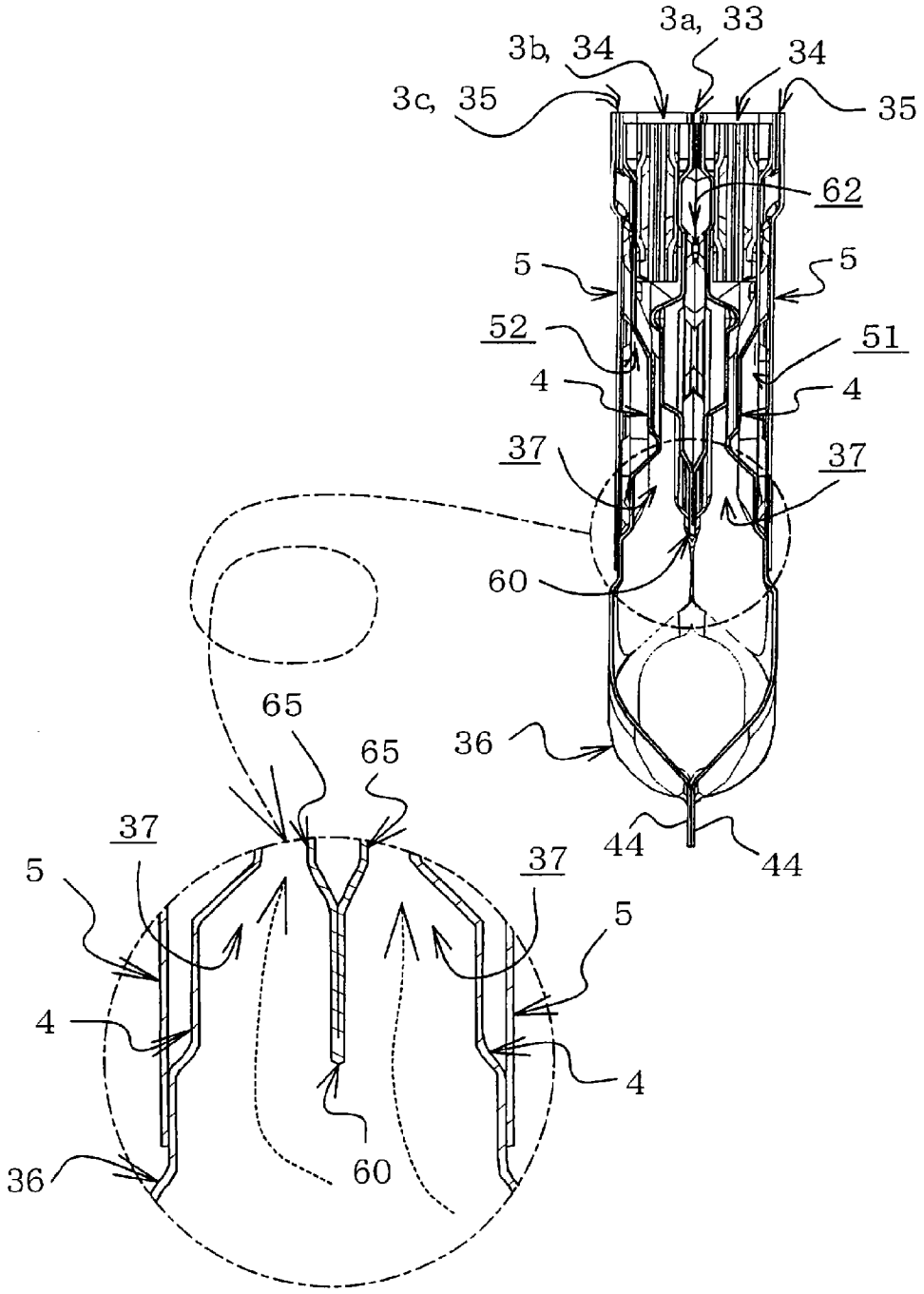
FIG. 13 is a partially enlarged cross-sectional illustration view taken along line H-H of FIG. 12.

In addition to the above, since the lower end part 60 of the central rich-side burner part 3*a* is formed by bending of a plate member 6*a* in the form of a single sheet, it becomes possible to ensure that shutoff is effected between the lean-side burner part 3*b* on the side of the tubular part 36 and the central rich-side burner part 3*a* to thereby maintain a state that sealability of high level is accomplished, even in the case where the lower end part 60 is exposedly disposed so as to divide the lean-side mixture supply channel into the two internal spaces 37, 37 at a location where the lean-side mixture supply channel formed by the tubular part 36 of the lean-side burner part 3*b* (see, for example, FIG. 12) curves upward after extension from the first supply port 31 on the front side (the right-hand side of FIG. 12) to the rear side (the left-hand side of FIG. 12).

Furthermore, if the following assembly structure is employed, this makes it possible that sealability is improved and secured to a further extent, whereby it becomes possible to ensure that the mixing between rich-side mixture and lean-side mixture is prevented. In other words, the step parts 422, 422 forming the slit part 423 on the other longitudinal side (the rear side, i.e., the left-hand side of FIG. 12) are formed so as to extend in a slightly downward sloping manner from above to below. In other words, the step parts 422, 422 extend in a sloping manner at an inclination (a slight angle of $\alpha$) in the vertical direction. And, the side edge 651 on the other longitudinal side (the rear side, i.e., the left-hand side of FIG. 12) of each plate part 65 of the third plate member 6 which is pushed into the slit part 423 from above is also formed so as to have the same taper angle.

Even in the case where the third plate member 6 is formed shorter in its longitudinal dimension due to variation in process, the third plate member 6 (see FIGS. 8 and 11) is, as described above, fit downward towards the inside from the upper end opening of the lean-side burner part 3*b*, so that the side edges 651, 651 are pushed into and guided along the sloping slit part 423, whereby the third plate member 6 moves just for a minute distance that compensates the process variation towards one longitudinal side from the other longitudinal side (from the left-hand side to the right-hand side in FIG. 12), thereby making it possible that the side edges 652, 653 on the one longitudinal side (the front side, i.e., the right-hand side in FIG. 12) are positioned at predetermined design locations. In addition, since especially the side edge 653 is positioned at its original design location in relation to the step part 431 of the side edge 43, this makes it possible to secure sealability. Owing to this, the mixing between rich-side mixture in the central rich-side burner part 3*a* and lean-side mixture in the lean-side burner part 3*b* via the joint portion between the side edge 653 and the side edge 43 is prevented without fail. Therefore, in addition to securing sealability and shutoff performance between the central rich-side burner part 3*a* and the lean-side burner part 3*b*, it is ensured that the rich-side flame hole row 33 of the central rich-side burner part 3*a* is positioned at a relative location as designed in positional relation to the lean-side flame hole row 34 of the lean-side burner part 3*b*, whereby it becomes possible to ensure that the combustion stability of lean-side flames by rich-side flames is secured.

Second Embodiment

Figure 14:
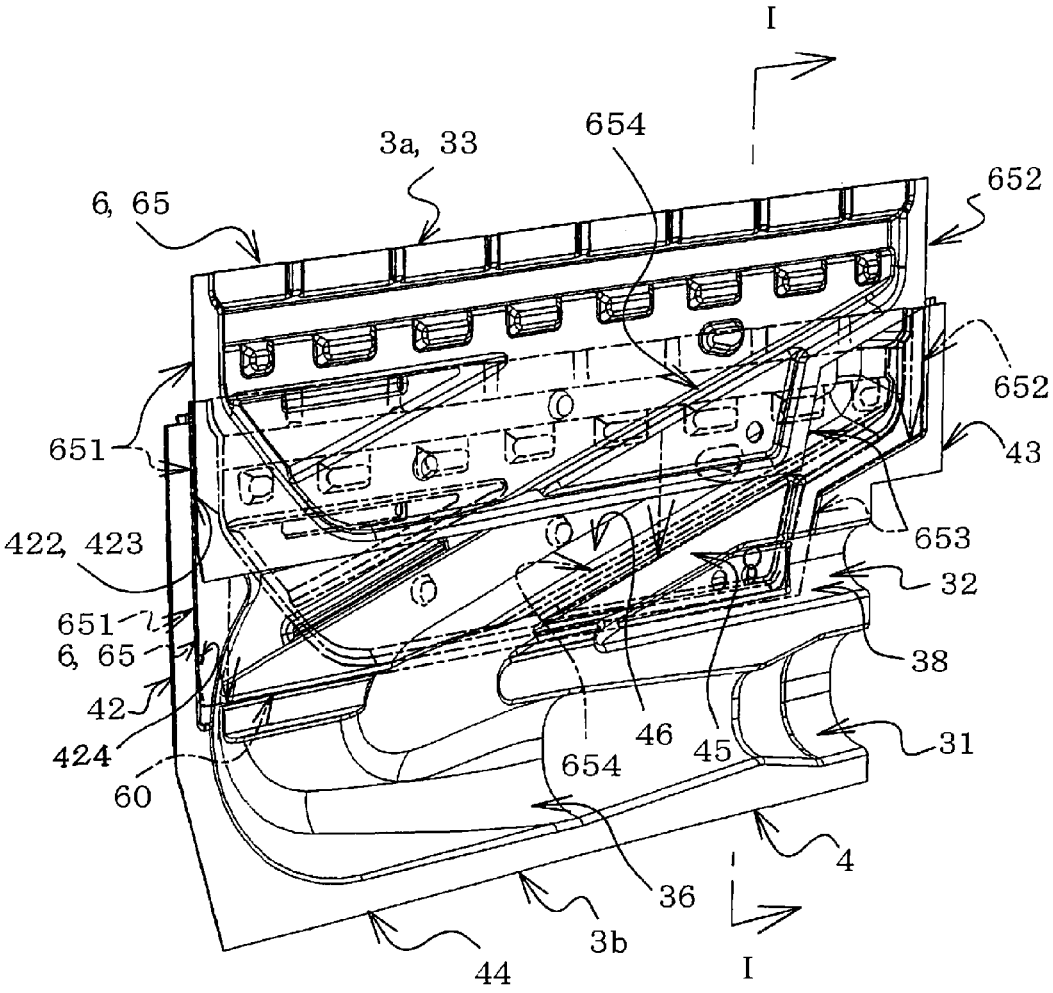
FIG. 14 is an exploded perspective view showing an assembly process of the third plate member in a state of being separated by line E-E of FIG. 2.
Figure 15:
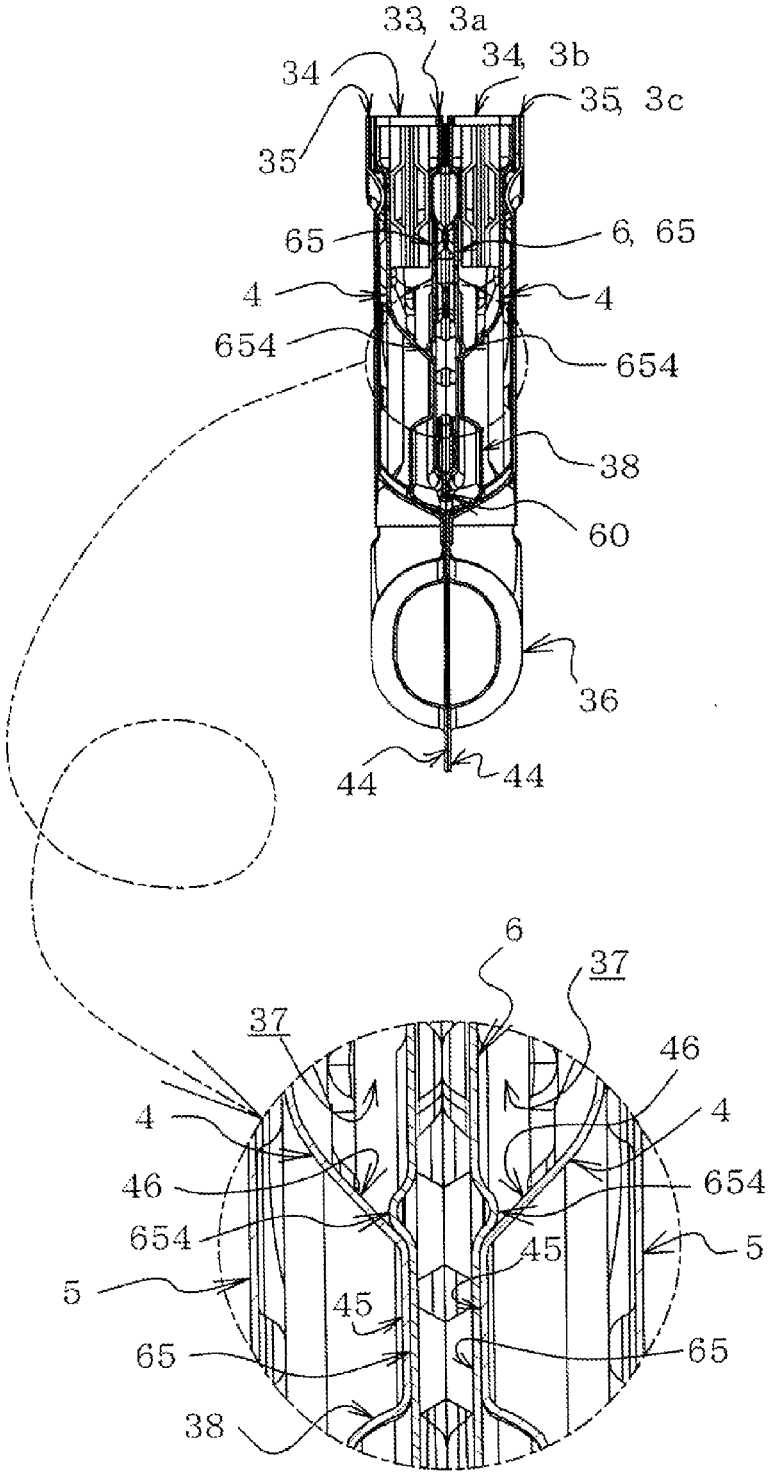
FIG. 15 is a partially enlarged cross-sectional illustration view taken along line H of FIG. 14.
Figure 16:
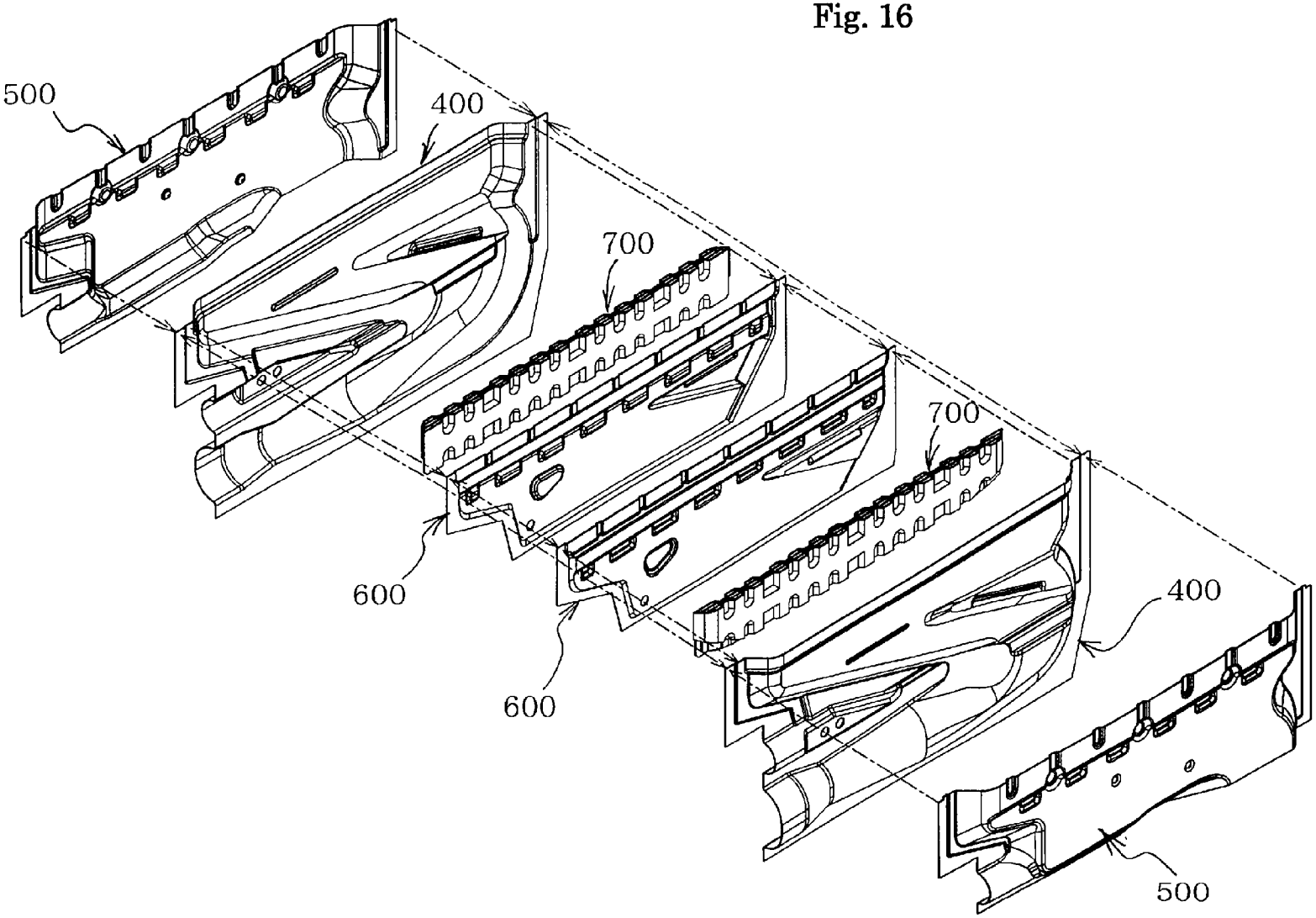
FIG. 16 is an illustration view for explaining problems to be solved by the present invention and is also an exploded perspective view in the case where a rich-lean combustion burner is assembled as follows: a pair of plate members are joined together to form a central rich-side burner part and other plate members are joined to the central rich-side burner part so as to sequentially enclose the outside thereof.

Referring to FIGS. 14 and 15, there is shown a rich-lean combustion burner according to a second embodiment of the present invention. In the second embodiment, a convex rib 654 is formed in each of the plate parts 65, 65 together making up the third plate member 6, whereby sealability is secured to a further extent. Other than this, the second embodiment is identical in other configuration with the first embodiment. Therefore, only different respects from the first embodiment will be described below.

The convex ribs 654 are formed respectively in the plate parts 65 of the third plate member 6. The convex ribs 654 are formed so as to project along the boundary locations of the internal spaces 37, 37 constituting supply channels for the lean-side burner part 3*b*. In other words, the internal space 37 is partition-formed in each first plate member 4 forming the lean-side burner part 3*b* so that the supply channel curves upward from the rear side of the tubular part 36 and then extends obliquely upward to the front side. Therefore, there is defined at an upper position of the tubular part 38 a joint surface in the shape of an inverted triangle (i.e., a joint surface indicated by letter P in FIGS. 5 and 7), and the convex rib 654 is projectingly formed, extending obliquely in the upward direction in each plate part 65 so as to be in abutment with the upside of an upper side of the joint surface 45 serving as a boundary.

As the third plate member 6 is fit and assembled to the lean-side burner part 3*b* from above to below (see the third plate member 6 indicated by sold line and alternate long and short dash line in FIG. 14), the convex rib 654 covers along the upside of the joint surface 45, thereby entering into an engaged state therewith, as shown in FIG. 15. Therefore, as described in the first embodiment, the outer surface of each plate part 65 closely contacts with the joint surface 45 by elastic resilience force working in the outward opening direction and, in addition, the convex rib 654 engages along the upside of the joint surface 45 serving as a boundary, whereby the rich-side mixture from the tubular part 38 and the lean-side mixture in the lean-side burner part 3*b* are shut off from each other to maintain a state of high sealability.

Other Embodiments

It may be arranged that the step part itself is vertically formed instead of forming the step part 422 in the first embodiment such that it obliquely slopingly extends at an inclination of a minute angle. In such a case, a minute projection (see, for example, a projection indicated by reference numeral 424 in FIG. 14) corresponding to the aforesaid minute angle is formed in a portion of the step part. By abutment of the side edges 651, 651 of the third plate member 6 against the projection, it becomes possible to make an adjustment for minute shifting to one longitudinal side of the third plate member 6 from the other longitudinal side thereof (from the left-hand side to the right-hand side in FIG. 14). Alternatively, it may be arranged that the projection 424 is further added to the step part 422 which obliquely slopingly extends at an inclination of the aforesaid minute angle.

What is claimed is:

1. A rich-lean combustion burner with one row of central rich-side flame holes longitudinally-aligned, two rows of lean-side flame holes aligned on outer sides of said one row of central rich-side flame holes, two rows of outer rich-side flame holes aligned on outer sides of said two rows of lean-side flame holes, said one row of central rich-side flame holes on which rich-side flames generated using a rich-side mixture supplied thereto through a rich-side mixture supply channel, and said two rows of lean-side flame holes on which lean-side flames generated using a lean-side mixture supplied thereto through a lean-side mixture supply channel, said rich-lean combustion burner comprising:

an inner plate member comprising a pair of plate parts facing each other, a bent part integrally connecting said plate parts at lower end thereof and an upper end opening, each of said plate parts having both longitudinal side edges, said inner plate member formed by bending the center of a single sheet of plate material so as to form said pair of plate parts and said bent part;

a pair of outer plate members which a predetermined clearance gap is formed therebetween, with slit parts provided at both longitudinal side edges of said pair of outer plate members, each of said slit parts having an inner width corresponding to the thickness of said side edges of said inner plate member and opening upward; and a pair of outermost plate members which is placed on the outside of said pair of outer plate members so as to form a predetermined clearance gap therebetween with opening at its upper end, wherein said one row of central rich-side flame holes is defined by said upper end opening of said inner plate member, wherein said two rows of lean-side flame holes are defined between both outer faces of said inner plate member and both inner faces of said pair of outer plate members, wherein said two rows of outer rich-side frame holes are defined between both outer faces of said pair of outer plate members and both inner faces of said pair of outermost plate members, wherein said inner plate member is assembled in said clearance gap between said outer plate members, with said side edges of said inner plate member pinched in said slit parts so as to close contact each other, whereby said rich-side mixture supply channel is defined between opposing surfaces of said pair of plate parts, and wherein said bent part of said inner plate member is exposedly disposed vertically halfway in said lean-side mixture supply channel partitioned and formed between said opposing surfaces of said pair of outer plate member, whereby said lean-side mixture supply channel is divided by said bent part of said inner plate member to provide separate extensions to said two rows of lean-side flame holes.

2. The rich-lean combustion burner as set forth in claim 1, wherein there is formed a convex rib which projects from the outer surface of each of said pair of plate parts of said inner plate member towards its opposing surface of said outer plate member and which extends along the boundary of a lean-side mixture supply channel partitioned and formed between the outer surface of each of said plate parts and said opposing surface of said outer plate member; and wherein said inner plate member is pushed in from said upper end opening of said outer plate member, whereby said convex rib is abuttingly fit against said opposing surface of said outer plate member.

3. A combustion apparatus which is provided with any one of the aforesaid rich-lean combustion burners as set forth in claim 2.

4. The rich-lean combustion burner as set forth in claim 1, wherein one of said slit parts that is situated on the other longitudinal side of said outer plate member is provided with a minute projection which projects from an end surface of said slit part; and wherein, when said inner plate member is pushed in from said upper end opening of said outer plate member, said inner plate member abuts against said projection, whereby said inner plate member is shifted a minute distance towards one longitudinal end from the other longitudinal end.

5. A combustion apparatus which is provided with any one of the aforesaid rich-lean combustion burners as set forth in claim 4.

6. The rich-lean combustion burner as set forth in claim 1, wherein one of said slit parts that is situated on the other longitudinal side of said outer plate member is formed for its end surface to slopingly extend at a slight downward inclination from above to below; and wherein, when said inner plate member is pushed in from said upper end opening of said outer plate member, said slit part is adapted to guide said inner plate member to be shifted a minute distance to one longitudinal side from the other longitudinal side.

7. A combustion apparatus which is provided with any one of the aforesaid rich-lean combustion burners as set forth in claim 6.

8. A combustion apparatus which is provided with any one of the aforesaid rich-lean combustion burners as set forth in claim 1.

* * * * *